US005366112A

United States Patent [19]

Hinterreiter

[11] Patent Number: 5,366,112

[45] Date of Patent: Nov. 22, 1994

[54] TABLET DISPENSER

[75] Inventor: Ignaz Hinterreiter, Linz, Austria

[73] Assignee: Patrafico AG, Zug, Switzerland

[21] Appl. No.: 768,775

[22] PCT Filed: Apr. 12, 1990

[86] PCT No.: PCT/AT90/00030

§ 371 Date: Feb. 27, 1992

§ 102(e) Date: Feb. 27, 1992

[87] PCT Pub. No.: WO90/11947

PCT Pub. Date: Oct. 18, 1990

[30] Foreign Application Priority Data

Apr. 12, 1989 [AT] Austria ..... 856/89-1

[51] Int. Cl.[5] ..... B65H 1/04; B65H 1/12

[52] U.S. Cl. ..... 221/198; 221/226; 221/229; 221/270; 221/312 B

[58] Field of Search ..... 221/312 B, 287, 226, 221/270, 279, 280, 64, 197, 198, 228, 229, 247

[56] References Cited

U.S. PATENT DOCUMENTS

| | | | |
|---|---|---|---|
| 1,878,354 | 9/1932 | Wessman | 221/279 X |
| 3,591,043 | 7/1971 | Murphy | 221/64 |
| 3,724,715 | 4/1973 | Auriemma | 221/279 X |
| 4,295,579 | 10/1981 | Haas | 221/198 X |
| 4,530,445 | 7/1985 | Decker | 221/198 |
| 5,048,720 | 9/1991 | Hoke | 221/198 |
| 5,100,022 | 3/1992 | Fukudome et al. | 221/198 |

FOREIGN PATENT DOCUMENTS

| | | |
|---|---|---|
| 0260250 | 3/1988 | European Pat. Off. . |
| 1112452 | 8/1961 | Germany . |

*Primary Examiner*—Robert P. Olszewski
*Assistant Examiner*—Dean A. Reichard

[57] ABSTRACT

A tablet dispenser comprises a tubular protective housing that has a guide shaft provided with longitudinal tracks for tablets that can be inserted in the form of a columnlike stack. A pressure-loaded ram for one end of the stack of tablets, feeds the tablets along the longitudinal tracks to an ejector that engages the stack adjacent to its other end, by which the tablets, which are guided between lateral guides adjacent to the ejector, can individually be displaced transversely to the longitudinal direction of the stack. In order to simplify the assembling and to increase the reliability in function and/or operation, the spring biasing the ram is accomodated in a spring shaft that is disposed beside the shaft for guiding and accomodating the tablets. The spring biases a guiding member that is guided in the spring shaft and carries the ram on an arm that extends out through a longitudinal slot through which the two shafts communicate with each other. For the stack of tablets, a magazine is provided, which can replaceably be inserted into the tablet-guiding shaft of the housing and has passage openings for the ram, a slot for guiding the ram-carrying arm and openings for ejecting the tablets.

10 Claims, 2 Drawing Sheets

TABLET DISPENSER

BACKGROUND OF THE INVENTION

1. Field of the Invention

This invention relates to a tablet dispenser comprising a tubular protective housing, in which a guide shaft is provided with longitudinal tracks for tablets, which can be inserted in the form of a column-like stack, and with a pressure-loaded ram for one end of the stack of tablets, which ram feeds the tablets along the longitudinal tracks to an ejector, which engages the stack adjacent to its other end by which the tablets, which are guided between lateral guides adjacent to the ejector, can individually be displaced transversely to the longitudinal direction of the stack.

Such tablet dispensers are preferably used for tablets which can easily be assembled in a column-like stack, such as tablets having a prismatic or cylindrical periphery. A main field of application of the tablet dispenser are refreshing tablets and lozenges which have basically the shape of a rectangular prism and contact each other on their flat sides in the stack.

2. Description of the Prior Art

In known tablet dispensers the longitudinal tracks for the stack of tablets are formed in a separate drawer, which at its end that protrudes out of the protective housing carries the ejector, and the drawer is open only on that side to which the tablets are pushed out so that the stack of tablets can be inserted from that side when the drawer has been pulled out. The ram, which in that case is longitudinally slidably guided in the drawer and in the housing, is supported at the inner end of the drawer by means of a compression spring, which is accommodated within the tablet-guiding shaft. As the empty drawer is pulled out, that ram engages detent means provided adjacent to the opening of the tube opening of the protective housing and said detent means prevent a further pulling out or pushing out of the ram. The drawer must be extractable at least by the length of the stack. Regardless of whether or not the drawer is filled, the compression spring tends to pull the drawer into the protective housing as far as to a stop and thus performs a dual function, because when the drawer has been pushed in the compression spring will advance the ram and the stack of tablets by the height of a tablet whenever a tablet has been taken.

The known tablet dispenser has various disadvantages. Above all, it is necessary to use relatively expensive springs which are of intricate shape in dispensers for rectangular prismatic tablets, which may consist of coil springs having convolutions contacting and extending along the periphery of a prism, and in assembling it is necessary to assemble the three parts consisting of the protective housing, drawer and spring in exactly predetermined positions and to insert the ram below the detent means of the protective housing. During a part of the assembling at least a part of the spring is prestressed between the spring and the drawer so that carelessness may have the result that the parts previously contacted with each other will be forced apart. Assembling can be effected only by hand rather than by automatic apparatuses. Most tablet dispensers of the present kind are definitely mass-produced articles so that the assembling costs have previously constituted a large share of the total costs. The spring which is provided is not only expensive in its manufacture, but has additional decisive disadvantages. The spring has a relatively high initial stress when the drawer has been pulled out. Faults in the manufacture of the tablet dispenser, normal wear in use or arbitrary damage may have the result that the ejector ram is no longer satisfactorily held by the detent means at the tube end of the protective housing but will jump out when the drawer has been pulled out so that the stack is then thrown out and the spring also jumps out along an uncontrollable path. Such a spring jumping out may inflict injuries mainly to the face and eyes and for this reason the previous tablet dispensers are objectionable also owing to that danger and to product liability.

In most cases it is usual to supply the stack of tablets in separate packages and to fill the tablet dispenser with the stack of tablets which has been taken from the package and in some cases even with individual tablets which are consecutively supplied. That procedure is expensive and because the stack or individual tablets must be grasped it is unhygienic. Besides, the stack often falls apart as it is transferred from the package into the tablet dispenser and in that case must be re-ordered.

Summary of the Invention

It is an object of the invention to provide a tablet dispenser which is of the kind described first hereinbefore and which can be manufactured and assembled more simply than the known tablet dispensers and has a reliability in operation and above all reliably prevents an uncontrolled jumping out of the ram and the spring. A partial object of the invention is to provide a tablet dispenser which can be supplied with the tablets quickly and satisfactorily from a hygienic aspect.

The main object set forth is accomplished in that the spring biasing the ram is accommodated in the housing in a spring shaft, which is disposed beside the shaft guiding and accommodating the tablets, and the spring biases a guiding member, which is guided in the spring shaft and which carries the ram on an arm, a carrying ring or a bracket, which extends out through a longitudinal slot through which the two shafts communicate with each other.

In the design in accordance with the invention the spring is accomodated in a protected arrangement and may have a simple shape, which can easily be manufactured. The spring together with the guiding member and the ram can separately be assembled when the spring is substantially relaxed so that the assembling will involve no difficulties and can be performed in automatic apparatuses. Contrary to the known design the ram need not occupy the entire cross-section for guiding the tablet so that there is no risk that abraded matter and other tablet residues may adversely affect the proper functions of the ram and the spring.

In a preferred embodiment the spring shaft is closed at the ejection end of the housing and at its opposite end has an opening which can be closed and serves to receive the guiding member and the spring, and the guiding slot is preferably open to that receiving opening so that the ram can be made to be integral with the arm and the guiding member and can be inserted jointly with the spring. A permanent, reliable closure may be provided for the receiving opening and may consist, inter alia, of inseparably inserted plugs or of sealants or the rims of the opening may be pressed after the assembling or such measures may be adopted in combination.

In accordance with a further preferred feature the tablet dispenser is associated with a magazine, which preferably constitutes a part of a tablet-guiding shaft of the housing and at least at one end of its length has a passage opening for the ram and at least at the other end of its length has lateral openings for receiving the ejector and for the ejection of the tablets and in that longitudinal side which faces the spring shaft in the inserted position is provided with a slot, which is aligned with the communicating longitudinal slot and serves to receive the arm which carries the ram.

Like openings are preferably provided at both ends of the magazine so that the magazine can selectively be inserted with one end or the other facing the ejection end. The magazine may consist of a plastic molding or of a relatively thick metal foil or the like so that only low costs are incurred in mass production. If the magazine constitutes also a part of the package, the other package costs will be lower than those of packages of the previous kind. The insertion of the magazine is much simpler than the introduction of a stack of tablets and the tablets themselves need not be grasped during the insertion and other manipulation so that the manipulation is much more hygienic than before.

In order to ensure a satisfactory longitudinal guidance of the tablets for the ejecting operation, an embodiment is preferred in which the tablet tracks of the magazine consist of longitudinal knife blades or combs, which are provided on and protrude from the inside of the walls of the magazine. The inner edges of the combs or knife blades, which protrude into the interior of the magazine housing, may be provided on at least two mutually opposite sides of the magazine within the contour line of the tablets so that combs or knives will form guiding grooves into the tablets of the inserted stack of tablets at least as the tablets are displaced to the ejector so that a more reliable guidance is achieved. A tilting of the tablets in the stack will reliably be prevented in any case even if the ram acts on the lowermost tablet only on a small contact surface.

The magazine preferably comprises walls which are resiliently deformable as the tablets are inserted between the edges disposed inside the contour of the tablets. With that design, the magazine can be filled with the tablets through a lateral opening, which substitutes one longitudinal wall and while the combs or knives resiliently engage the tablets and retain the tablets and in transit hold the tablets against dislocation and against falling out through the receiving opening.

Further structural features of the tablet dispenser may be adopted from various aspects. In a possible embodiment the magazine can be inserted into the protective housing from the ejection end of the housing and the ejector is attached to the housing itself and for the inserting operation can be swung away, e.g., like a flap, from the corresponding opening, and the ejector is locked by detent means in its operative position. In a different embodiment the housing has a lateral opening for receiving the magazine and during the insertion of the magazine the ram is retracted to such an extent by means of handles acting on the guiding member and/or the spring that the ram can be engaged with that end of the stack which faces away from the ejector. In that case a back member of the magazine may close the lateral housing opening and, e.g., may supplement the housing to form a handle.

In accordance with a further feature of the tablet dispenser in accordance with the invention the stack of tablets is accommodated in a manner known per se in a drawer, which is adapted to be pulled out as far as to a stop from the end of the protective housing and carries the ejector at that end which protrudes from the housing when the drawer has been inserted, the drawer has a lateral opening for receiving the stack of tablets and/or the magazine and a slot for guiding the ram arm, and the drawer is adapted to be fixed in its inserted position by a releasable braking catch. In that embodiment, the tablets or the stack of tablets or the magazine can be inserted in the customary manner when the drawer has been pulled out of the protective housing. Because the drawer is no longer acted upon by the spring, it need not be held in its pulled-out position so that the tablets can be inserted more simply. Nevertheless, the drawer is locked in its pushed-in position by the braking catch. The restraining force of that braking catch must somewhat exceed the force which is exerted by the spring via the ram to the stack of tablets to push out that stack. In spite of the use of that drawer, there is no risk that an actuation of that drawer may cause the spring or the ram to be released and/or thrown out.

In a preferred embodiment of that last-mentioned design, the braking catch consists of a resilient braking tongue, which is provided and/or integrally formed adjacent to that end of the drawer which can be inserted into the housing and said tongue particularly constitutes a part of a drawer end wall provided at that end and with its free end applies pressure to that wall portion of the housing which is opposite to the receiving slot, said tongue is arched as it thus applies pressure, and like an overcenter spring assumes a bent position protruding into the drawer as the drawer is inserted and as the drawer is pulled out is reversely bent beyond the dead center to a braking position protruding outwardly over the drawer. That embodiment of the bracking catch is particularly simple and in the preferred embodiment the tongue can be formed jointly with the drawer if the drawer is made of a suitable material. The design can further be simplified if the ram and/or its carrying arm when fully extended protrudes with its underside out of the housing at least to the extent of the spring excursion of the spring tongue, which has integrally been formed with the end wall of the drawer and the spring tongue which downwardly protrudes beyond the drawer (and assumes that position as the drawer is pulled out of the housing) constitute catches which limit the extraction of the drawer.

BRIEF DESCRIPTION OF THE DRAWINGS

The subject matter of the invention is illustrated by way of example in the drawing, in which.

DETAILED DESCRIPTION OF A PREFERRED EMBODIMENT

Figure 2:
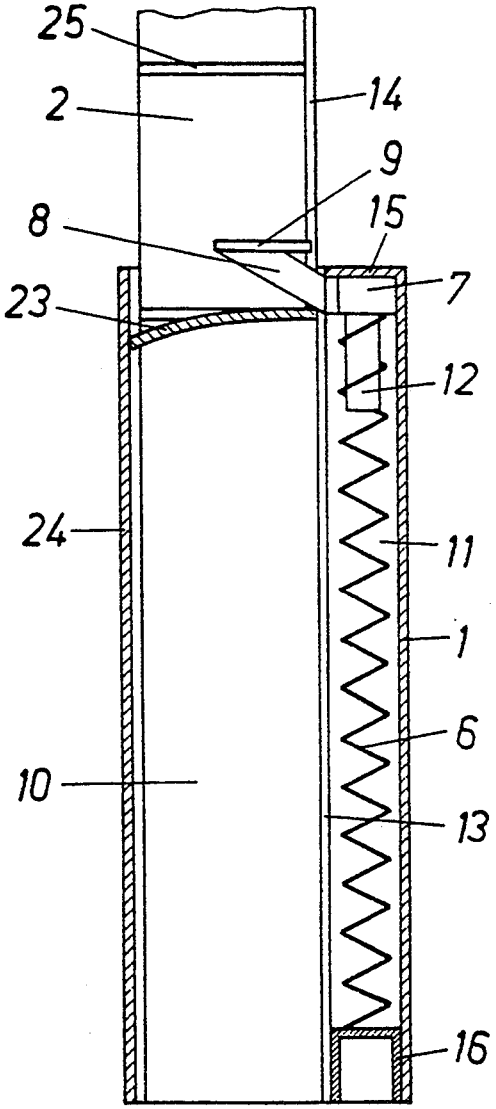
FIG. 2 is a corresponding longitudinal sectional view showing the housing with the drawer pulled out before a magazine is inserted.

The illustrated tablet dispenser consists of a protective housing 1, a drawer 2 provided with an ejector 3, the contours of which are shown in phantom, a magazine 4, which can be inserted into the drawer 2 and contains a stack of individual tablets 5 (not shown in FIGS. 2 and 3) a spring 6, a guiding member 7 and a ram 9, which is connected to that guiding member by an arm 8.

The protective housing 1 comprises a tablet- or drawer-guiding shaft 10, which extends throughout the length of the housing, and besides that shaft comprises a shaft 11 for guiding the spring 6 and the guiding member 7, which has a core pin 12 extending into the spring, which consists of a cylindrical coil spring 6. The shafts 10 and 11 communicate with each other through a slot 13 for guiding the arm 8. The drawer 2 has a slot 14, which is aligned with the slot 13.

The spring-guiding shaft 11 is closed at its top by a top wall portion 15. After the guiding member 7, the arm 8 with the ram 9, and the spring 6 have been inserted, the spring-guiding shaft 11 is permanently closed by an insert 16.

As has been mentioned the back of the drawer 2 is formed with the slot 14. The front side of the drawer 2 is shown on the left in FIG. 1 and is open so that the magazine 4 can be inserted. The forward and rear side walls of the drawer 2 are extended to provide bearing brackets 17 for the ejector 3, which is pivoted to said bearing brackets on a transverse pivot 18. End wall extensions 19 of the drawer 2 constitute a top stop for the magazine. As a continuation in length of said end wall extensions a leaf spring 20, which is made of plastic, is attached and serves as a restoring spring for the ejector 3, which has an ejector claw 21 for pushing out the presently uppermost tablet 5*a* transversely to the longitudinal direction of the stack when the ejector is pivotally moved by means of an actuating handle 22.

The drawer 2 contains a supporting partition 25 for supporting the magazine at its bottom end. At the bottom end of the drawer, a drawer end wall is provided, which is integrally formed with a spring tongue 23, which extends into a trough-shaped recess 24 in the front side of the housing and under a resilient initial stress applies pressure to that wall portion of the recess 24 which is opposite to the slot 13. As the drawer is slidably inserted, the spring tongue 23 assumes the position shown in FIG. 1. As the drawer 2 is pulled out, the spring tongue 23 swings to the position shown in FIG. 2. In that pulled-out position the associated drawer bottom provided with the spring tongue 23 engages the ram 9 and/or the arm 8 to constitute a lock that prevents the drawer from being pulled out. But when the drawer has been swung to the right (FIG. 2) the drawer can be pushed so that the slot 14 receives the arm 8 and when the tongue 23 is in the swung position shown in FIG. 1 the drawer can be hung into the housing 1. When the drawer 2 has shortly been inserted and retracted the tongue 23 will swing back to its locking position shown in FIG. 2. In that case the drawer 2 can be demounted only in that the spring tongue 23 is tilted from below to its other swung position by means of an implement which is inserted into the shaft 10.

Figure 1:
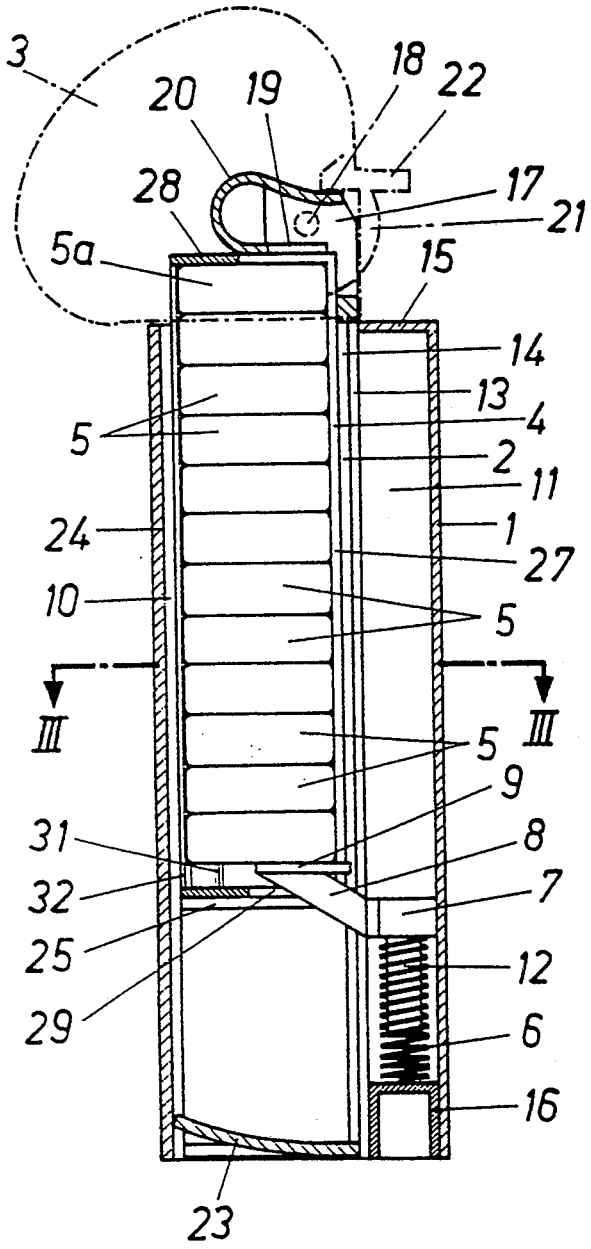
FIG. 1 shows a tablet dispenser which is in accordance with the invention and is shown with an inserted stack of tablets in position for use; the protective housing, a drawer provided here and a magazine for the stack of tablets are shown in longitudinal section and the contours of a tablet ejector attached to the drawer are shown in phantom.
Figure 3:
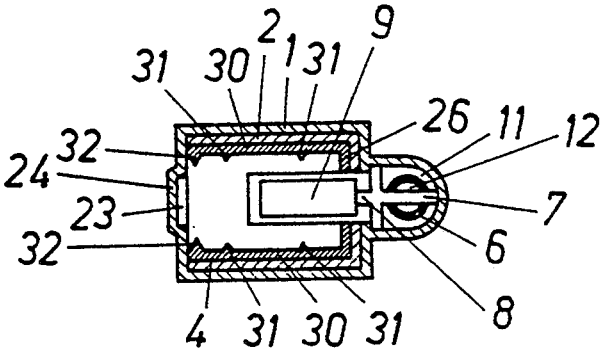
FIG. 3 is a sectional view showing the housing with the drawer pulled out before a magazine is inserted.
Figure 4:
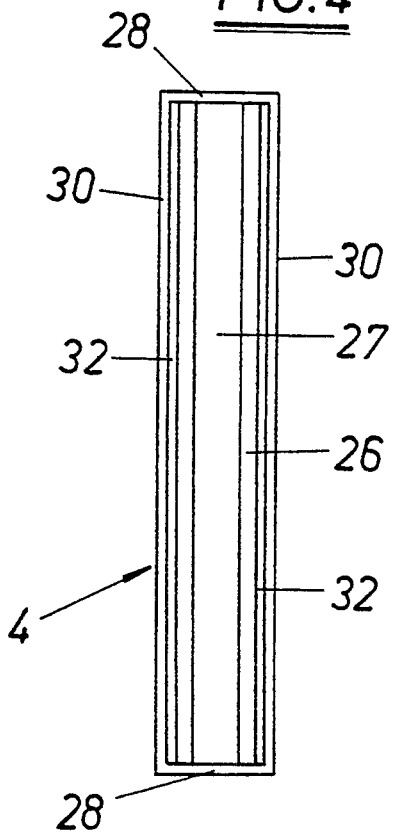
FIG. 4 is a front elevation showing the magazine provided in accordance with FIGS. 1 and 3.

The magazine 4 shown in FIGS. 1, 3 and 4 comprises a rear wall 26, which has a slot 27 that is aligned with the slots 13 and 14, end walls 28 having equal and opposite openings 29 for receiving the carrying wall 8 and the ram 9 and side walls 30, which on their inside surfaces facing the stack of tablets carry guide ribs 31, 32. The stack of tablets 5 can be inserted while the walls 30 are resiliently spread apart. The ribs 32 will then snap in behind the inserted tablets and the ribs 31 constitute knife blades, which cut guiding grooves into the tablets during their longitudinal displacement. The ejector claw 21 can be inserted through the slot 27. The uppermost tablet 5*a* is ejected to the left while the ribs 32 are forced apart.

Figure 5:
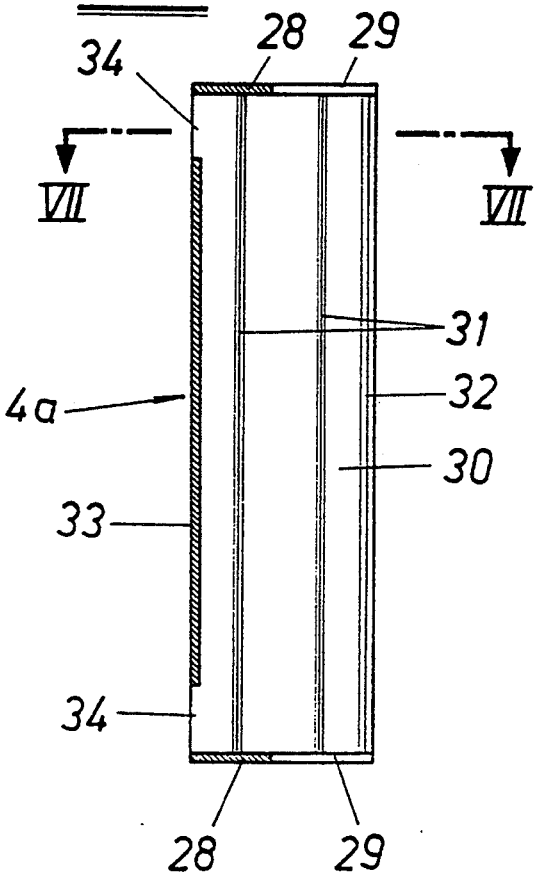
FIG. 5 is a longitudinal sectional view showing the magazine.
Figure 6:
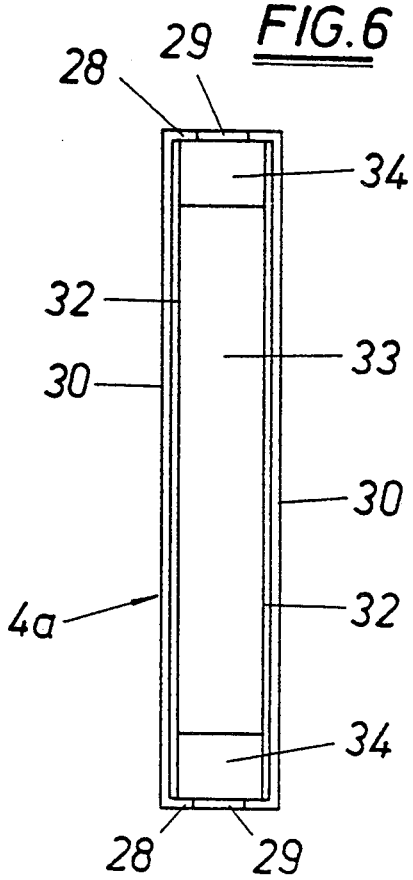
FIG. 6 is an elevation showing the magazine of FIG. 5 viewed from the right.
Figure 7:
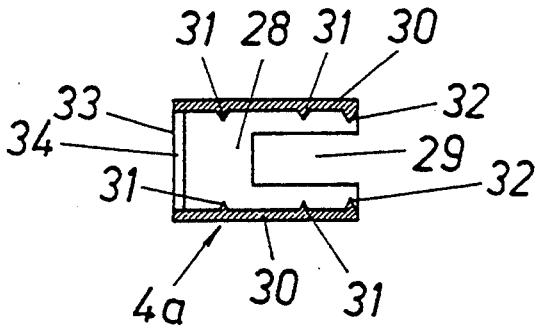
FIG. 7 is a sectional view taken on line VII–VII in FIG. 5.

On that side which faces the recess 24 the magazine 4*a* shown in FIGS. 5 and 7 comprises a longitudinal wall 33, which at its top and bottom leaves windows 34 open for the ejection of the tablets 5. On the other hand the slot 27 has been omitted as well as the rear wall 25 and the side walls 30 are provided with the ribs 31, 32 in an arrangement which is equal and opposite to that of the magazine 4 shown in FIGS. 1, 2 and 4. In that case the ribs 32 serve only to retain the tablets after they have been inserted into the magazine and the tablets are ejected through that window 34 which in a given case is adjacent to the ejector.

The magazines 4, 4*a* constitute a package for the stack of tablets and must be provided only with a simple wrapper for sale or shipment.

What is claimed is:

1. A tablet dispenser comprising a tubular protective housing having a guide shaft for guiding and accommodating tablets that are insertable in said guide shaft in a column-like stack having first and second ends and a longitudinal direction, a spring shaft disposed adjacent said guide shaft, and a longitudinal slot through which said guide shaft and said spring shaft communicate with each other, said guide shaft being provided with longitudinal tracks for said tablets; an ejector arranged to engage said stack adjacent said first end of said stack for individually displacing said tablets transversely to said longitudinal direction of said stack; lateral guides adjacent said ejector for guiding said tablets; a pressure-loaded ram adjacent said second end of said stack for feeding said tablets along said longitudinal tracks; a spring accommodated in said spring shaft for biasing said ram; a guide member biased by said spring and guided in said spring shaft, said guide member extending through said longitudinal slot and including an arm that carries said ram; and a magazine that is provided with said longitudinal tracks for said tablets and is adapted to be replaceably inserted into said guide shaft, said magazine having a first end including an opening for receiving said ram, a second end including lateral openings for receiving said ejector and for ejecting said tablets, and a longitudinal slot in said housing for receiving said arm when said magazine is inserted in said guide shaft.

2. A tablet dispenser according to claim 1, wherein said housing has an ejection end and an opposite end, and said spring shaft is closed at said ejection end of said housing and has a closable opening at said opposite end for receiving said guiding member and said spring.

3. A tablet dispenser according to claim 1, further comprising inside wall surfaces on said magazine, wherein said longitudinal tracks for said tablets are selected from the group consisting of knife blades and combs and are provided on and protrude from said inside wall surfaces.

4. A tablet dispenser according to claim 3, wherein said magazine has at least two mutually opposite sides, said tablets have a contour line and said longitudinal tablet tracks are provided on said at least two mutually opposite sides of said magazine within said contour line of said tablets, so that said longitudinal tablet tracks will form guiding grooves in said tablets when said magazine is inserted in said guide shaft.

5. A tablet dispenser according to claim 4, wherein said magazine comprises walls that are resiliently deformable when said tablets are inserted between said longitudinal tablet tracks.

6. A tablet dispenser according to one of claims 1 to 5, wherein said protective housing has an ejection end, said ejector is attached at said ejection end of said protective housing and is swingable to an open position for ejecting said tablets, and said magazine is insertable into said protective housing from said projection end.

7. A tablet dispenser according to one of claims 1 to 5, further comprising a stop; and a drawer for accommodating said stack of tablets, said drawer being adapted to be inserted to an inserted position in said protective housing to protrude at a first end from said protective housing and to be pulled out of said protective housing as far as said stop, said drawer being adapted to carry said ejector at said protruding first end, said drawer having a lateral opening for receiving at least one of said stack of tablets and said magazine and a slot for receiving said guiding arm; and a releasable braking catch adapted to hold said drawer in said inserted position.

8. A tablet dispenser according to claim 7, wherein said braking catch comprises a resilient tracking tongue adjacent a second end of said drawer and insertable into said protective housing, said tongue having a free end that is adapted to apply pressure on a wall portion of said protective housing opposite said longitudinal slot, said tongue being adapted to be arched into a bent position protruding into said drawer like an overcenter spring as said drawer is inserted into said protective housing and to bend in reverse beyond dead center to a braking position protruding outwardly over said drawer as said drawer is pulled out of said protective housing.

9. A tablet dispenser according to claim 8, wherein at least one of said ram and said carrying arm is adopted when fully extended to protrude outside of said protective housing at least to the extent of the excursion of said tongue, so that said end wall of said drawer and said downwardly-protruding tongue constitute braking catches for said drawer.

10. A tablet dispenser according to claim 1, further comprising a stop; and a drawer for accommodating said stack of tablets, said drawer being adapted to be inserted to an inserted position in said protective housing to protrude at a first end from said protective housing and to be pulled out of said protective housing as far as said stop, said drawer being adapted to carry said ejector at said protruding first end, said drawer having a lateral opening for receiving at least one of said stack of tablets and said magazine and a slot for receiving said guiding arm; and a releasable braking catch adapted to hold said drawer in said inserted position, wherein said braking catch comprises a resilient tracking tongue adjacent a second end of said drawer and insertable into said protective housing, said tongue having a free end that is adapted to apply pressure on a wall portion of said protective housing opposite said longitudinal slot, said tongue being adapted to be arched into a bent position protruding into said drawer like an overcenter spring as said drawer is inserted into said protective housing and to bend in reverse beyond dead center to a braking position protruding outwardly over said drawer as said drawer is pulled out of said protective housing, said tongue being integrally formed as part of said second end of said drawer.

* * * * *